US005673520A

United States Patent [19]

Yannucci, III

[11] Patent Number: 5,673,520

[45] Date of Patent: Oct. 7, 1997

[54] SKYLIGHT AND/OR CHIMNEY WATER DIVERSION DEVICE

[76] Inventor: Alfred Yannucci, III, 127 Woodside Rd., Mastic Beach, N.Y. 11951

[21] Appl. No.: 249,721

[22] Filed: May 26, 1994

[51] Int. Cl.[6] ..... E04D 13/14

[52] U.S. Cl. ..... 52/58; 52/24; 52/200; 52/219; 285/42

[58] Field of Search ..... 52/24, 97, 62, 52/58, 200, 218, 219; 285/42, 44, 43

[56] References Cited

U.S. PATENT DOCUMENTS

| | | | |
|---|---|---|---|
| D. 134,337 | 11/1942 | Cutshall | 52/97 X |
| 316,861 | 4/1885 | Apple | 285/43 |
| 596,266 | 12/1897 | Hind | 52/97 X |
| 618,074 | 1/1899 | Dyer | 52/58 |
| 853,897 | 5/1907 | Porter | 52/58 |
| 1,442,172 | 1/1923 | Nelson | 52/58 |
| 1,694,521 | 12/1928 | Tucker | 52/58 |
| 1,967,105 | 7/1934 | Seymour | 52/58 |
| 3,521,414 | 7/1970 | Malissa | 52/200 X |
| 4,391,068 | 7/1983 | Kosar | 52/97 |
| 4,810,025 | 3/1989 | Riley | 296/146 |
| 5,056,277 | 10/1991 | Wilson | 52/62 |
| 5,077,943 | 1/1992 | McGady | 52/58 |
| 5,109,641 | 5/1992 | Halan | 52/62 |
| 5,333,419 | 8/1994 | Hickner | 52/62 X |

FOREIGN PATENT DOCUMENTS

| | | | |
|---|---|---|---|
| 2523575 | 12/1975 | Germany | 285/43 |
| 4323453 | 11/1992 | Japan | 52/200 |
| 5005345 | 1/1993 | Japan | 52/97 |
| 62468 | 5/1940 | Norway | 52/24 |
| 833539 | 4/1960 | United Kingdom | 52/58 |
| 2212831 | 8/1989 | United Kingdom | 52/58 |

*Primary Examiner*—Carl D. Friedman
*Assistant Examiner*—Laura A. Saladino
*Attorney, Agent, or Firm*—Richard L. Miller, P.E.

[57] ABSTRACT

A diversion device for a skylight and/or chimney on a shingled pitched roof in a building comprising a substantially flat base, a structure integral with the base for diverting rainwater and an upstanding flange integral with the rainwater diverting means. The base can be positioned under a portion of the shingled pitched roof, while the upstanding flange can be positioned over the flashing of the skylight and/or chimney. The rainwater flowing down along the shingled pitched roof will be deflected away from the skylight and/or chimney by the rainwater diverting structure, to prevent the rainwater from entering the building and causing damage thereto.

2 Claims, 1 Drawing Sheet

SKYLIGHT AND/OR CHIMNEY WATER DIVERSION DEVICE

BACKGROUND OF THE INVENTION

The instant invention relates generally to water deflectors and more specifically it relates to a roof structure water diversion device for such typical structures as skylights and/or chimneys.

Numerous water deflectors have been provided in prior art that are adapted to prevent water from leaking through roofs in building and utility doors in recreation vehicles. For example, U.S. Pat. Nos. 4,391,068 to Kosar; 4,810,025 to Riley; 5,056,277 to Wilson and 5,109,641 to Halan all are illustrative of such prior art.

While these units may be suitable for the particular purpose to which they address, they would not be as suitable for the purposes of the present invention as heretofore described.

SUMMARY OF THE INVENTION

A primary object of the present invention is to provide a skylight and/or chimney water diversion device that will overcome the shortcomings of the prior art devices.

Another object is to provide a skylight and/or chimney water diversion device that will deflect rainwater around the skylight or chimney on a pitched roof of a building, to prevent the rainwater from entering the building and causing damage thereto.

An additional object is to provide a skylight and/or chimney water diversion device that will reduce the flow of rainwater to the original flashing in the building, as much as ninety five percent which will eliminate existing or potential leaks.

A further object is to provide a skylight and/or chimney water diversion device that is simple and easy to use.

A still further object is to provide a skylight and/or chimney water division device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

Figure 4:
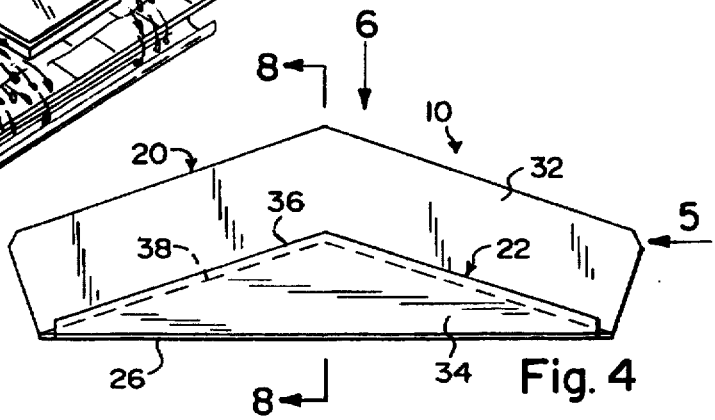
FIG. 4 is a top view taken generally in the direction of arrow 4 in FIG. 1 of the instant invention per se but before it has been installed.
Figure 5:
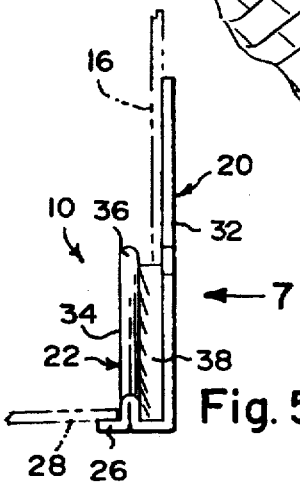
FIG. 5 is an enlarged end view taken in the direction of arrow 5 in FIG. 4 of the instant invention with the shingles and the flashing of a typical installation shown in phantom.
Figure 6:
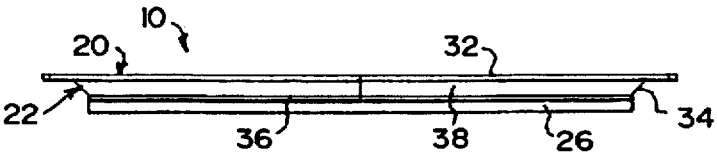
Figure 8:
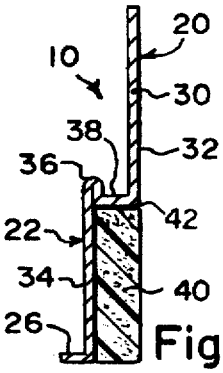
Figure 7:
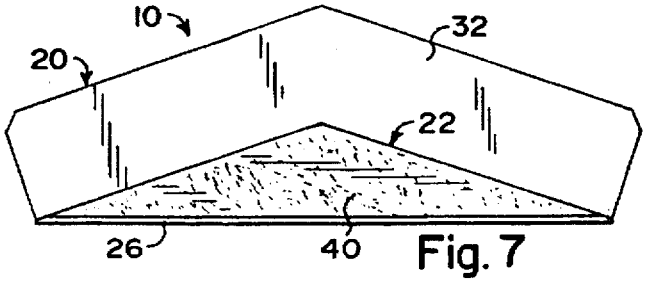

FIG. 6 is an inverted side view taken in the direction of arrow 6 in FIG. 4; and FIG. 7 is a bottom view taken in the direction of arrow 7 in FIG. 5; and FIG. 8 is an enlarged cross sectional view taken on line 8—8 of FIG. 4.

DETAILED DESCRIPTION OF THE PREFERRED EMBODIMENTS

Turning now descriptively to the drawings, in which similar reference characters denote similar elements throughout the several views, FIGS. 1 through 8 illustrate a diversion device 10 for a skylight 12 and or chimney 14 on a shingled pitched roof 16 in a building 18 comprising a substantially flat base 20, a structure 22 integral with the base 20 for diverting rainwater 24 and an upstanding flange 26 integral with the rainwater diverting structure 22. A portion of the base 20 can be positioned under a portion of the shingled pitched roof 16, while the upstanding flange 26 can be positioned over the flashing 28 of the skylight 12 or chimney 14. The rainwater 24 flowing down along the shingled pitched roof 16 will be deflected away from the skylight 12 or chimney 14 by the rainwater diverting structure 22, to prevent the rainwater 24 from entering the building 18 and causing damage thereto.

The base 20, the rainwater diverting structure 22 and the upstanding flange 26 are formed typically out of sheet material 30, typically such as aluminum, copper or plastic (see FIG. 8), which has been appropriately folded and seamed to form substantially a wing-snaped member 32.

The rainwater diverting structure 22 is an elongate triangular-shaped member 34 formed having a folded lip 36 with a channel 38 located at the integral connection with the base 20. An elongate triangular-shaped backing piece 40, which maybe fabricated out of plastic or polystyrene foam is secured, typically with a suitable adhesive 42, to the underside of the elongate triangular-shaped member 34, so as to give strength and stability thereto, and prevent accidental crushing should the device be inadvertently walk on or stepped upon.

OPERATION OF THE INVENTION

Figure 1:
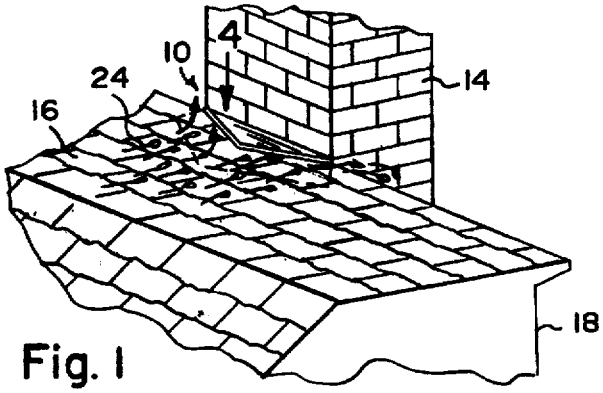
FIG. 1 is a diagrammatic perspective view of a typical installation utilizing the invention to divert rain around a chimney.
Figure 3:
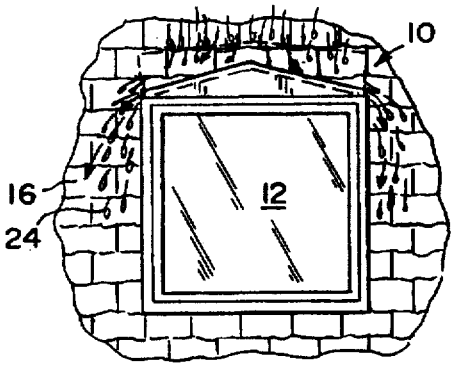
FIG. 3 is a diagrammatic elevational view illustrating the instant invention diverting rain around another skylight installation.
Figure 2:
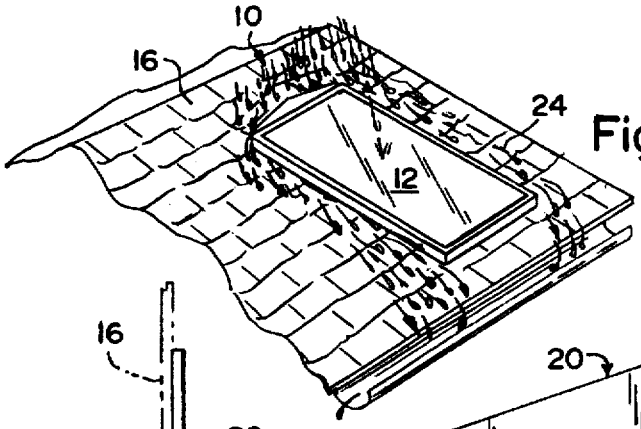
FIG. 2 is a diagrammatic perspective view illustrating the instant invention being utilized to divert rain around a skylight installation.

The diversion device 10 is installed with the base 20 under a portion of the shingled pitched roof 16 and the upstanding flange 26 placed over the flashing 28 of the skylight 12, as shown in FIG. 2 and 3 or the chimney 14, shown in FIG. 1. When rainwater 24 flows down the shingled pitched roof 12, the rainwater diverting structure 22 will cause the rainwater 24 to flow on opposite sides and away from the skylight 12 or chimney 14. This will prevent water seepage from entering the building 18.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A rainwater diversion device for a roof structure on a shingled pitched roof of a building comprising:

a) a substantially flat, sheet-form base for receipt under shingles of a portion of a shingled pitched roof;

b) means integrally connected with said base for diverting rainwater comprising an elongate, triangular-shaped member formed from sheet material with a folded lip defining a channel at an integral connection with said base, an apex of the member joining said base at a central location thereof so that the channel comprises two portions which diverge as they extend away from the apex;

c) an upstanding flange integrally connected with said rainwater diverting means on an outer side of the channel remote from the base, so that a portion of said base can be positioned under a portion of the shingled pitched roof, while said upstanding flange can be positioned over flashing of the roof structure causing the rainwater flowing down along the shingled pitched roof to be deflected into and along the channel away from the roof structure, on either side thereof.

2. A diversion device as recited in claim 1, wherein said base, said rainwater diverting means and said upstanding flange are formed of sheet material and further including an elongate triangular-shaped backing piece secured to an inner side of said elongate triangular-shaped member, so as to give strength and stability thereto.

* * * * *